United States Patent [19]

Hackett et al.

[11] Patent Number: 4,490,270

[45] Date of Patent: Dec. 25, 1984

[54] SANITIZING LIQUID SHAMPOO FOR CARPETS

[75] Inventors: Walter J. Hackett, Westminster; Kyle K. Ito, Huntington Beach, both of Calif.

[73] Assignee: Purex Corporation, Lakewood, Calif.

[21] Appl. No.: 402,587

[22] Filed: Jul. 28, 1982

[51] Int. Cl.[3] ..... C11D 3/44; C11D 3/48

[52] U.S. Cl. ..... 252/106; 252/139; 252/532; 252/526; 252/171

[58] Field of Search ..... 252/106, 135, 139, 90, 252/88, 89.1, 171, 143, 531, 532, DIG. 14; 424/333

[56] References Cited

U.S. PATENT DOCUMENTS

| | | | |
|---|---|---|---|
| 3,282,775 | 11/1966 | Stonehill | 252/106 X |
| 3,357,922 | 12/1967 | Bellinger | 252/106 |
| 3,497,456 | 2/1970 | Goodell | 252/139 X |
| 3,723,358 | 3/1973 | Morgan et al. | 252/546 |
| 3,728,265 | 4/1973 | Cella et al. | 252/90 |
| 3,736,259 | 5/1973 | Buck et al. | 252/139 X |
| 3,748,268 | 7/1973 | Loudas | 252/90 |
| 3,919,101 | 11/1975 | Anstett et al. | 252/90 |

FOREIGN PATENT DOCUMENTS

| | | |
|---|---|---|
| 530462 | 12/1972 | Switzerland . |
| 998495 | 7/1965 | United Kingdom . |

OTHER PUBLICATIONS

Hackh's Chemical Dictionary, Fourth Ed., 1969, McGraw-Hill, Inc., N.Y., p. 277.

*Primary Examiner*—Prince E. Willis

*Attorney, Agent, or Firm*—William W. Haefliger

[57] ABSTRACT

An aqueous solution composition for use in cleaning and sanitizing carpets and the like consists of surfactant, inorganic phosphate, glutaraldehyde, solvent and brightener, as for example in the relative weight percentages claimed herein.

14 Claims, No Drawings

SANITIZING LIQUID SHAMPOO FOR CARPETS

BACKGROUND OF THE INVENTION

This invention relates generally to cleaning of carpets and rugs, and more particularly concerns cleaning compositions or shampoos of this type which impart a sanitizing action.

A major concern in the care of carpeting, besides basic cleanliness, is the reduction of the microbial contaminants to safe levels as determined by public health requirements, known simply as sanitizing, while meeting Efficacy Data Requirements outlined in series DIS/TSS-8, dated Feb. 6, 1979 of the United States Environmental Protection Agency, as well as in their modifications DIS/TSS-8, Apr. 13, 1981 and May 27, 1981.

Accordingly, there is need for a shampoo which will meet the above requirements; also, there is need for such a sanitizing shampoo capable of use in foam-type shampooers, and rotary brush-type shampooers, and also capable of hand brush or sponge use.

SUMMARY OF THE INVENTION

It is a major object of the invention to provide a shampoo composition, and process of use thereof, that will meet the above needs.

Basically, the composition of the invention is an aqueous solution for use in cleaning and sanitizing carpets and the like, and consists essentially of (a) between 0.1 and 20.0 weight percent surfactant, (b) between 0.03 and 5.0 weight percent inorganic phosphate, (c) between 0.05 and 5.0 weight percent glutaraldehyde, (d) between 0.0 and 25.0 weight percent solvent, (e) between 0.002–1.0 weight percent optical brightener and the balance water.

As will appear, the glutaraldehyde active sanitizer is present in a typical composition, prior to dilution upon application, in the relative proportion about 1.5 weight percent; and the composition is diluted for application in the appropriate volumetric proportions 1 part composition to 24 parts water.

DETAILED DESCRIPTION

The aqueous shampoo compositions of the present invention are based on the provision of mixtures of a foaming surfactant or surfactants; an inorganic buffer; solvents; optical brightener; and glutaraldehyde as the active sanitizer. As will appear, the shampoo is prepared by adding the ingredients to water, with agitation, in any sequence, provided that the glutaraldehyde is added last.

Usable surfactants are sodium lauryl sulfate, REWOPOL SBL 203 (Emery Industries) and sodium lauryl ether sulfate; a usable optical brightener is TINOPAL CBS (Ciba-Geigy Corp.); usable solvents are isopropanol, propylene glycol methyl ether, amyl acetate, methylene chloride, 2-Butoxy ethanol; and a usable inorganic buffer salt is monopotassium phosphate. REWOPOL SBL 203 is a fatty acid alkylolamide sulfosuccinate. TINOPAL CBS is a hypochlorite stable cotton fluorescent whitening agent of the distyryl biphenyl type.

Relative weight ranges of ingredients are as follows:

TABLE I

| Ingredients | Weight % Range |
|---|---|
| Surfactant | 0.1–20.0% |
| Inorganic Buffer | 0.03–5.0% |
| Solvents | 0.2–25.0% |
| Optical brightener | 0.002–1.0% |
| Glutaraldehyde | 0.05–5.0% |
| Water (carrier) | balance |

The following examples are illustrative of the composition of the invention:

EXAMPLE I

| Ingredients | Parts |
|---|---|
| Water | 79.70 |
| Tinopal CBS | 0.05 |
| Sodium Lauryl Sulfate | 12.60 |
| Isopropanol | 3.00 |
| Propylene Glycol Methyl Ether | 2.00 |
| Amyl Acetate | 0.25 |
| Monopotassium Phosphate | 0.90 |
| Glutaraldehyde | 1.50 |

EXAMPLE II

| Ingredients | Parts |
|---|---|
| Water | 82.70 |
| Tinopal CBS | 0.05 |
| Sodium Lauryl Sulfate | 9.60 |
| Rewopol SBL 203 | 3.00 |
| 2-Butoxy ethanol | 2.00 |
| Amyl Acetate | 0.25 |
| Monopotassium Phosphate | 0.90 |
| Glutaraldehyde | 1.50 |

EXAMPLE III

| Ingredients | Parts |
|---|---|
| Water | 83.50 |
| Isopropanol | 5.92 |
| Sodium Lauryl Sulfate | 4.47 |
| Sodium Lauryl Ether Sulfate | 3.64 |
| Amyl Acetate | 0.02 |
| Tinopal CBS | 0.05 |
| Monopotassium Phosphate | 0.90 |
| Glutaraldehyde | 1.50 |

EXAMPLE IV

| Ingredients | Parts |
|---|---|
| Water | 63.10 |
| Isopropanol | 16.50 |
| Sodium Lauryl Sulfate | 12.60 |
| Amyl Acetate | 0.30 |
| Methylene Chloride | 5.00 |
| Monopotassium Phosphate | 0.90 |
| Glutaraldehyde | 1.50 |
| Tinopal CBS | 0.05 |
| Sodium EDTA | 0.05 |

In use, any of the above example formulas is diluted with water in the proportion: 1 unit volume of formula to 24 unit volumes of water. The resultant solution is then applied to the carpet, or the like, using a foam-type shampooer, rotary brush shampooer, or by hand brush or sponge, the carpet fibers being effectively wiped or brushed clean and sanitized, simultaneously.

A wide range of dilution is available depending upon the concentration of glutaraldehyde within the concentrated (pre-dilution) product and particularly within the 0.05 to 5.0% glutaraldehyde range referred to above, providing the pH of the diluted solution is within the pH range referred to below.

The pH of the applied solution ranges between 5.8 and 6.2, and it is applied at room temperature. It is characterized as relatively inexpensive and as satisfying the EPA standards referred to.

We claim:

1. An aqueous solution composition for use in cleaning and sanitizing carpets and the like that consists essentially of the following ingredients in the stated relative weight percents:

(a) between 0.1 and 20.0 weight percent surfactant, selected from the group consisting of sodium lauryl sulfate, a fatty acid alkylolamide sulfosuccinate and sodium lauryl ether sulfate, (b) between 0.03 and 5.0 weight percent monopotassium phosphate, (c) between 0.05 and 5.0 weight percent glutaraldehyde, (d) solvent that consists essentially of about 3.0 weight percent isopropanol, about 2.0 weight percent propylene glycol methyl ether, and about 0.25 weight percent amyl acetate, (e) between 0.002 and 1.0 weight percent optical brightener, and the balance water.

2. The composition of claim 1 wherein about 1.50 weight percent glutaraldehyde is present in the solution.

3. The composition of claim 1 wherein between 63.10 and 83.50 weight percent water is present in the solution.

4. The composition of claim 1 wherein the brightener consists of about 0.05 weight percent of a hypochlorite stable cotton fluorescent whitening agent of distyryl biphenyl type.

5. An aqueous solution composition for use in cleaning and sanitizing carpets and the like that consists essentially of the following ingredients in the stated relative weight percents:

(a) between 0.1 and 20.0 weight percent surfactant selected from the group consisting of sodium lauryl sulfate, a fatty acid alkylolamide sulfosuccinate and sodium lauryl ether sulfate, (b) between 0.03 and 5.0 weight percent monopotassium phosphate, (c) between 0.05 and 5.0 weight percent glutaraldehyde, (d) solvent that consists of about 3.0 weight percent isopropanol, about 2.0 weight percent 2-Butoxy ethanol, and about 0.25 weight percent amyl acetate, (e) between 0.002 and 1.0 weight percent optical brightener, and the balance water.

6. An aqueous solution composition for use in cleaning and sanitizing carpets and the like that consists essentially of the following ingredients in the stated relative weight percents:

(a) between 0.1 and 20.0 weight percent surfactant selected from that group consisting of sodium lauryl sulfate, a fatty acid alkylolamide sulfosuccinate and sodium lauryl ether sulfate, (b) between 0.03 and 5.0 weight percent monopotassium phosphate, (c) between 0.05 and 5.0 weight percent glutaraldehyde, (d) solvent that consists of about 5.92 weight percent isopropanol and about 0.02 weight percent amyl acetate, (e) between 0.002 and 1.0 weight percent optical brightener, and the balance water.

7. An aqueous solution composition for use in cleaning and sanitizing carpets and the like that consists essentially of the following ingredients in the stated relative weight percents:

(a) between 0.1 and 20.0 weight percent surfactant selected from the group consisting of sodium lauryl sulfate, a fatty acid alkylolamide sulfosuccinate and sodium lauryl ether sulfate, (b) between 0.03 and 5.0 weight percent monopotassium phosphate, (c) between 0.05 and 5.0 weight percent glutaraldehyde, (d) solvent that consists of about 16.50 weight percent isopropanol and about 0.30 weight percent amyl acetate, (e) between 0.002 and 1.0 weight percent optical brightener, and the balance water.

8. An aqueous solution composition for use in cleaning and sanitizing carpets and the like that consists essentially of the following ingredients in the stated relative weight percents:

(a) between 0.1 and 20.0 weight percent surfactant selected from the group consisting of sodium lauryl sulfate, a fatty acid alkylolamide sulfosuccinate and sodium lauryl ether sulfate, (b) between 0.03 and 5.0 weight percent monopotassium phosphate, (c) between 0.05 and 5.0 weight percent glutaraldehyde, (d) solvent that consists of about 16.50 weight percent isopropanol, about 6.0 weight percent mythylene chloride and about 0.30 weight percent amyl acetate, (e) between 0.002 and 1.0 weight percent optical brightener, and the balance water.

9. The method of preparing an aqueous solution for use in cleaning and sanitizing carpets that includes providing a solution composition as defined in claim 1 and diluting said solution by mixing with water in the proportion about 1 part solution composition and about 24 parts water.

10. The method of preparing an aqueous solution for use in cleaning and sanitizing carpets that includes providing a solution composition as defined in claim 1, and diluting said solution by mixing with water, the pH of the resultant solution being between 5.8 and 6.2.

11. The method of preparing the solution composition of claim 1 wherein ingredients (a), (b), (d) and (e) are mixed, and lastly ingredient (c) is added and mixed.

12. The method of cleaning a carpet or the like that comprises applying to the carpet or the like the composition of any one of claims 1, 5, 6, 7 and 8, in an aqueous carrier.

13. The method of cleaning a carpet or the like that comprises diluting the composition of any one of claims 1, 5, 6, 7 and 8 to provide a dilute aqueous solution having a pH between 5.8 and 6.2 and applying to the carpet said solution dispensed from a shampooer, rotary brush, hand brush or sponge.

14. The method of claim 12 which includes adjusting the solution pH to lie between 5.8 and 6.2 prior to said application.

* * * * *